US005622021A

United States Patent [19]

Bookout

[11] Patent Number: 5,622,021

[45] Date of Patent: Apr. 22, 1997

[54] WALL BRACE APPARATUS AND METHOD FOR HOLDING TOGETHER AND SUPPORTING WALLS AND FOR FORMING AN ARENA

[75] Inventor: Timothy A. Bookout, Coppell, Tex.

[73] Assignee: Rapid Rink Systems, L.L.C., Stafford, Tex.

[21] Appl. No.: 422,063

[22] Filed: Apr. 7, 1995

[51] Int. Cl.[6] ..... F04B 2/74; F04H 17/00

[52] U.S. Cl. ..... 52/582.1; 52/152; 52/745.1; 248/351; 256/27; 256/31; 472/92

[58] Field of Search ..... 52/582.1, 27, 220.7, 52/245, 246, 127.2, 146, 152, 153, 169.7, 745.05, 745.09, 745.1; 472/92, 93, 94; 248/351, 188.8, 188.91; 249/189, 192, 210, DIG. 3; 256/19, 24, 25, 27, 30, 31

[56] References Cited

U.S. PATENT DOCUMENTS

| | | | |
|---|---|---|---|
| 8,555 | 12/1851 | Cole | 256/31 |
| 82,865 | 10/1868 | Olds | 256/31 |
| 94,828 | 9/1869 | Johnson | 256/30 |
| 110,899 | 1/1871 | Collins | 256/30 |
| 516,858 | 3/1894 | Cleather et al. . | |
| 795,646 | 7/1905 | Plummer | 256/31 |
| 2,205,398 | 6/1940 | Eaton | 472/94 |
| 2,624,468 | 1/1953 | McCauley | 248/351 X |
| 3,383,108 | 5/1968 | Reilly . | |
| 3,991,530 | 11/1976 | Scourtes | 52/146 |
| 4,048,771 | 9/1977 | Thistlethwaite | 52/127.2 |
| 4,059,248 | 11/1977 | Kuntz . | |
| 4,068,427 | 1/1978 | Camardo | 52/127.2 X |
| 5,343,667 | 9/1994 | Peden | 52/127.2 |

FOREIGN PATENT DOCUMENTS

| | | | |
|---|---|---|---|
| 2235864 | 7/1972 | Germany | 52/146 |

*Primary Examiner*—Michael Safavi
*Attorney, Agent, or Firm*—Steven Lin

[57] ABSTRACT

A wall brace apparatus and method for holding together and supporting walls and also for forming an arena or walled enclosed structure. Wall brace 10 or 15 has a frame 30, a top bracing member 40, and a bottom bracing member 50 for holding together, bracing, and supporting respective top sides and respective bottom sides of walls 60 adjacently to and in alignment with each other. Wall braces 10 or 15 are used to hold walls 60 to form side walls, and walls 60 can be easily assembled and disassembled from the top and bottom bracing members 40 and 50. Wall brace 20 or 25 also has a frame 30, a top bracing member 45, and a bottom bracing member 55 for holding together, bracing, and supporting respective sides of walls 60 at an angle to each other. Wall braces 20 or 25 are used to hold walls 60 to form corner walls, and the walls 60 can also be easily assembled and disassembled from the top and bottom bracing members 45 and 55. An arena 100 can be constructed from a plurality of walls 60, a plurality of wall braces 10 or 15, and a plurality of wall braces 20 or 25.

33 Claims, 4 Drawing Sheets

WALL BRACE APPARATUS AND METHOD FOR HOLDING TOGETHER AND SUPPORTING WALLS AND FOR FORMING AN ARENA

BACKGROUND OF THE INVENTION

1. Fields of the Invention

The present invention relates to a wall brace apparatus and method for holding together and supporting walls, and, more particularly, to a wall brace apparatus and method for holding together and supporting walls to form an arena or walled enclosed structure.

2. Discussion of Background and Prior Art

Presently, there are a number of events or sports in which the use of an arena or enclosed ring is desired or required. The problem with most arenas or enclosed rings, however, is that they require a fairly large amount of space in order to be constructed, and they can be quite costly, especially if the arena or ring being constructed is a permanent structure. On the other hand, there are many situations in which a temporary or knockdown type structure is sufficient or even desired to satisfy the needs of some arena users when these users consider the costs, the type of use, and the amount they use the arena.

For example, U.S. Pat. No. 516,858 to G. G. Cleather and P. J. Gibson ("Cleather") discloses such a temporary ring structure. Cleather discloses an improved knockdown and moveable ring enclosure, which is particularly used for exhibiting and judging dogs or other animals. Cleather discloses that each wall section of the ring or enclosure has a swinging brace that can fold or swing inwardly when the wall is not used or is being put away or can fold or swing outwardly and be attached to the ground or floor when the wall is being used to support the wall in an upright manner. Cleather further discloses that the posts of each wall section are secured to the ground or floor, and it also teaches that the adjoining wall sections are attached together by the use of bolts.

Furthermore, the need or demand for temporary or knockdown type arenas or ring structures has increased over the last several years, especially with the increasing popularity of sports that require arenas or rings. Rollerskating, rollerblading, rollerskate hockey, rollerblade hockey, and floor hockey are some of the more popular sports that require an arena or ring and that are ideal for the use of a temporary knockdown arena or ring since they could be assembled when they are being used and disassembled and stored away when they are not being used.

There is a need for a wall brace apparatus and method for holding walls together and supporting them in upright positions, and, in particular, for holding walls together to form an arena or ring (i.e. a temporary or knockdown arena or ring structure). It is an object of the present invention to provide a wall brace that can hold and brace walls together and support them in upright positions and that can also be easily attached or detached from the walls. It is also another object of the present invention to provide a wall brace that does not require the use of bolts or any other type of fixed attachment means to the walls or to the ground or floor in order to hold together and support the walls in upright positions. Furthermore, it is another object of the present invention to provide an arena or ring that can be easily assembled so that it can be used and easily disassembled so that it can be moved or conveniently stored or put away.

Another advantage of a temporary or knockdown arena or ring is that it can be used for a multiple number of purposes (i.e. sports, events, shows, exhibitions, fairs, etc.). The arena or ring can be disassembled so that it does not occupy a lot of space or is not in the way when it is stored. The easy disassembly of the arena also provides the advantage of allowing space, which would otherwise be occupied by the arena, to be used for other purposes.

Therefore, a wall brace apparatus and method for holding walls together and supporting them in upright positions, and, in particular, for holding and supporting walls to form an arena, is desired, and it is an object of the present invention to overcome the problems and limitations of the prior art that have just been discussed.

SUMMARY OF THE INVENTION

Set forth below is a brief summary of the invention in order to solve the foregoing problems and achieve the foregoing and other objects, benefits, and advantages in accordance with the purposes of the present invention as embodied and broadly described herein.

It is one aspect and advantage of the present invention to provide a wall brace for holding at least two walls together and supporting the at least two walls in upright positions having a frame that has a support member and a base which provides support to the at least two walls to maintain the at least two walls in upright positions, a top bracing member attached to the support member of the frame for holding together top sides of the at least two walls, and a bottom bracing member attached to the base of the frame for holding together bottom sides of the at least two walls.

It is another aspect and advantage of the present invention to provide a method of holding at least two walls together and supporting the at least two walls in upright positions that includes the steps of bracing respective top sides of the at least two walls together with a top bracing member and further bracing respective bottom sides of the at least two walls with a bottom bracing member, and supporting the top bracing member and the bottom bracing member with a frame to maintain the at least two walls in upright positions.

It is another aspect and advantage of the present invention to provide an arena that can be easily assembled and disassembled having a plurality of individual wall panels, a plurality of side wall braces wherein each side wall brace has a top bracing member and a bottom bracing member for receiving and holding at least two individual wall panels adjacently and in general alignment with each other at respective top sides and respective bottom sides of the at least two wall panels and wherein the plurality of side wall braces support a number of the at least two wall panels in upright positions to form side walls, and a plurality of corner wall braces wherein each corner wall brace has a top bracing member and a bottom bracing member for receiving and holding at least two individual wall panels at an angle to each other at respective top sides and respective bottom sides of the at least two wall panels and wherein the plurality of corner wall braces support a number of the at least two wall panels in upright positions to form corner walls.

It is still another aspect and advantage of the present invention to provide a method of constructing an arena that can be easily assembled and disassembled comprising the steps of providing a plurality of individual wall panels, a plurality of side wall braces, and a plurality of corner wall braces, slidingly mounting and bracing ends of at least two individual wall panels into top and bottom bracing members of each side wall brace so that the at least two wall panels are adjacent and in general alignment with each other at respective top sides and respective bottom sides of the wall panels and so that a number of at least two wall panels are supported in upright positions to form side walls of the arena, slidingly mounting and bracing ends of at least two individual wall panels into top and bottom bracing members of each corner wall brace so that the at least two wall panels are at an angle to each other at respective top sides and respective bottom sides of the wall panels and so that a number of at least two wall panels are supported in upright positions to form corner walls of the arena, and slidingly mounting and bracing a last individual wall panel between a first next-to-last wall panel and a second next-to-last wall panel to enclose the arena.

DETAILED DESCRIPTION OF THE PREFERRED EMBODIMENT

Figure 1:
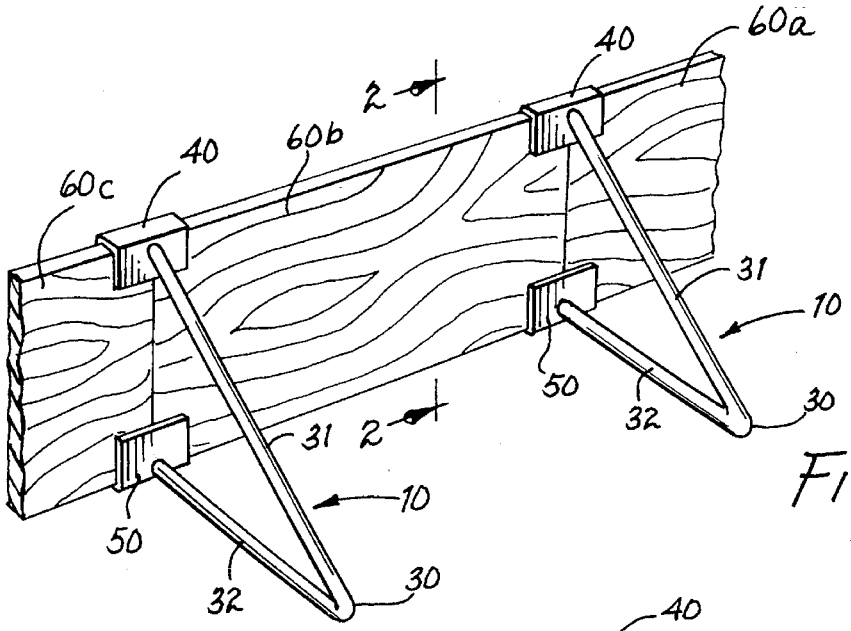
FIG. 1 Rear Perspective View of a First Embodiment of the Present Wall Brace Invention for Holding Together Walls and Supporting Them in Upright Positions.

The First Embodiment Wall Brace (Side Wall Brace)

FIGS. 1–4 show different views of a first embodiment wall brace 10 for holding walls 60 (which includes wall panels 60*a*, 60*b*, and 60*c* of FIG. 1) together and supporting these walls in upright positions. Walls 60 include panels, boards, and any other type of wall structure. Referring to FIGS. 1–4, each wall brace 10 holds at least two walls 60 together and supports these two walls 60 in upright positions. As shown in these figures, a plurality of walls 60 are held adjacently (i.e. side-by-side) to and in general alignment with each other by a number of wall braces 10.

Each wall brace 10 includes a frame 30 that has a support member 31 and a base 32. In FIGS. 1–4, frame 30 is generally shown to be a triangular shape having a vertical open side in which the two walls 60 are received. Frame 30 is typically made of tubing material, and in FIGS. 1–4, the tubing material is bent at an angle so that the support member 31 and the base 32 form the generally triangular shape of the frame 30. The frame 30 provides support to the two walls 60 to maintain these two walls in upright positions. Furthermore, base 32 can have a flat bottom that rests on the ground, floor, or the surface which supports the walls 60. Also, the length of the base 32 is made approximately equal to or longer than the height of the two walls 60 to ensure further support and to provide further stability to the two walls 60 being maintained in upright positions.

Figure 2:
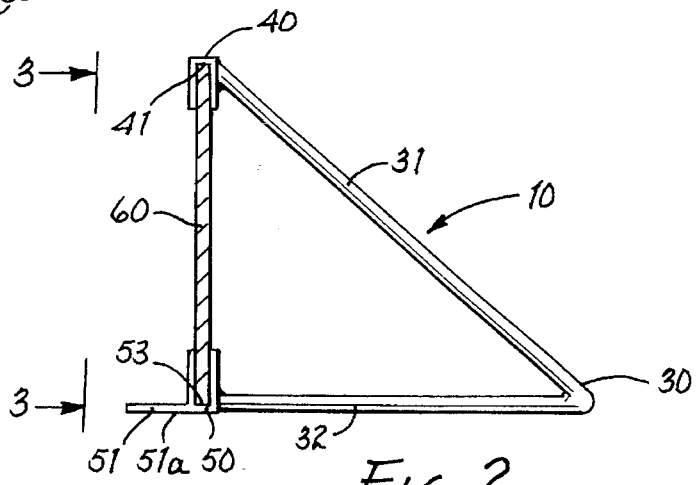
FIG. 2 Side View of the First Embodiment Wall Brace Invention taken along the line 2—2 of FIG. 1.
Figure 3:
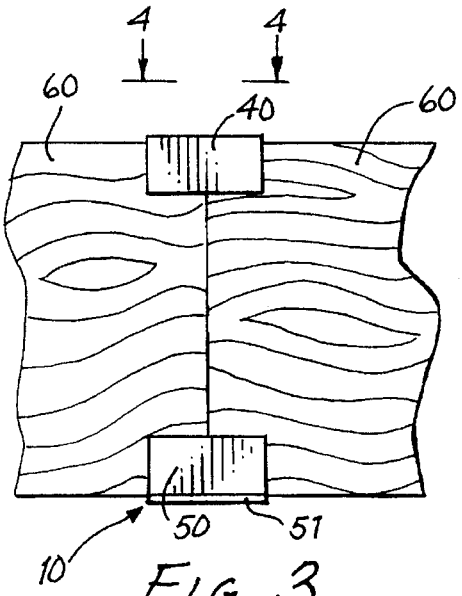
FIG. 3 Front View of the First Embodiment Wall Brace Invention taken along the line 3—3 of FIG. 2.
Figure 4:
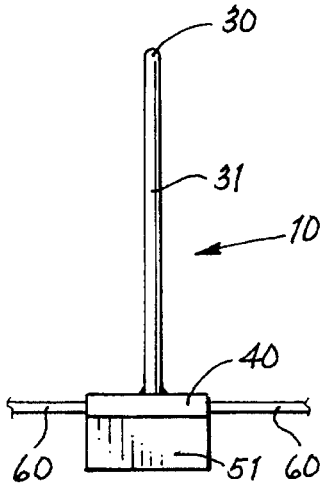
FIG. 4 Top Plan View of the First Embodiment Wall Brace Invention taken along the line 4—4 of FIG. 3.

In FIGS. 1, 2, and 4, a top bracing member 40 is attached to an upper end of the support member 31 (i.e. the upper end of support member 31 is attached to a metal plate side of bracing member 40). The top bracing member 40 is generally a straight rectangular clamp that has an open side and two open ends. As shown in FIGS. 1, 3, and 4, top sides from each of the two walls 60 are received into the open side and the two open ends of the clamp of the top bracing member 40, and, the clamp covers, braces, and holds the top sides of the two walls 60 together adjacently to and in general alignment with each other. The top bracing member 40 is made of metal plate material (i.e. typically 12 gauge metal plates).

In FIGS. 1 and 2, a bottom bracing member 50 is attached to an end of base 32 so that bottom bracing member 50 is vertically and directly underneath top bracing member 40 (i.e. the end of base 32 is attached to a metal plate side of bracing member 50). Bottom bracing member 50 is also a straight rectangular clamp having an open side and two open ends. As shown in FIGS. 1 and 3, bottom sides from each of the two walls 60 are received into the open side and two open ends of the clamp of the bottom bracing member 50, and the clamp covers, braces, and holds the bottom sides of the two walls 60 together (i.e. as shown in FIGS. 1 and 3, the clamp holds the bottom sides of the two walls 60 adjacently to and in general alignment with each other). The bottom bracing member 50 is made of metal plate material (i.e. typically 12 gauge metal plates).

In FIGS. 1–4, the wall brace 10 is constructed so that when the top bracing member 40 and the bottom bracing member 50 are attached to the frame 30, an inner top surface 41 of the top bracing member 40 and an inner bottom surface 53 of the bottom bracing member 50 are made to be a height apart from each other that is slightly smaller than the height of the walls 60. The wall brace 10 is constructed in this manner so that the frame 30 has to be slightly bent outwardly in order to insert the two walls 60 into the bracing members 40 and 50 and so that the two walls 60 firmly or snugly fit between the two bracing members.

As shown in FIGS. 2–4, a flat plate 51 is also attached to the bottom bracing member 50. In FIG. 2, flat plate 51 has horizontal surface 51*a* that extends outwardly from the bracing member 50. As shown in FIG. 2, the horizontal surface 51*a* also rests on the ground, floor, or surface that supports the walls 60 (i.e. the ground, floor, or surface generally opposite to that on which the base 30 rests) to provide further support and stability to the walls 60 and to further ensure that these walls are maintained in upright positions.

Wall braces 10 are constructed in the above manner so that the walls 60 can be easily assembled to and disassembled from the top bracing member 40 and bottom bracing member 50, and the wall braces 10 do not use bolts or any type of fixed attachment means to fasten the walls 60 together or to attach the walls 60 to the ground or floor. Serrated teeth 70 can also be attached to inner portions of the top bracing member 40 and to inner portions of the bottom bracing member 50 to respectively grip or further hold the top sides and the bottom sides of the two walls 60 (i.e. See FIG. 10).

Figure 9:
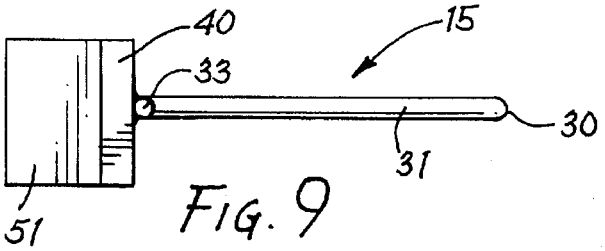
FIG. 9 Top Plan View of Another Version of the First Embodiment Wall Brace Invention.
Figure 10:
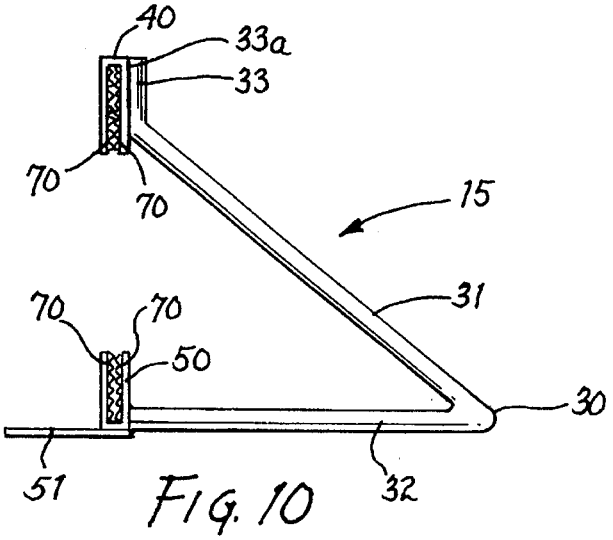
FIG. 10 Side View of the First Embodiment Wall Brace Invention of FIG. 9.
Figure 11:
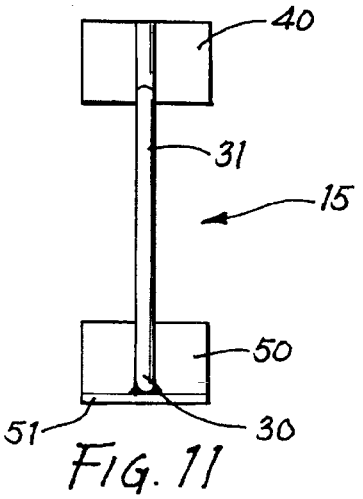
FIG. 11 Rear View of the First Embodiment Wall Brace Invention of FIG. 10.

FIGS. 9–11 show a wall brace 15, which is another version of the first embodiment wall brace. Wall brace 15 is virtually identical to the above-described wall brace 10, and it also encompasses all of the features and advantages of wall brace 10. The main difference between wall braces 10 and 15, however, is that wall brace 15 has an additional vertical member 33 attached at the upper end of support member 31. As shown in FIG. 10, the vertical member 33 has a vertical surface 33*a* to which virtually an entire side of the top bracing member is attached.

The first embodiment wall braces generally function as side wall braces to hold together and support side walls of a structure (i.e. an arena or ring structure).

The Second Embodiment Wall Brace (Corner Wall Brace)

Figure 6:
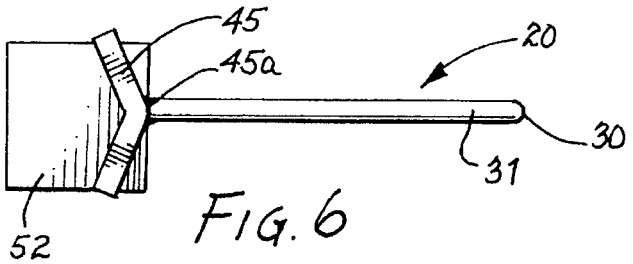
FIG. 6 Top Plan View of a Second Embodiment Wall Brace Invention for Holding Together Walls and Supporting Them in Upright Positions FIG. 7 Side View of the Second Embodiment Wall Brace Invention of FIG. 6.
Figure 7:
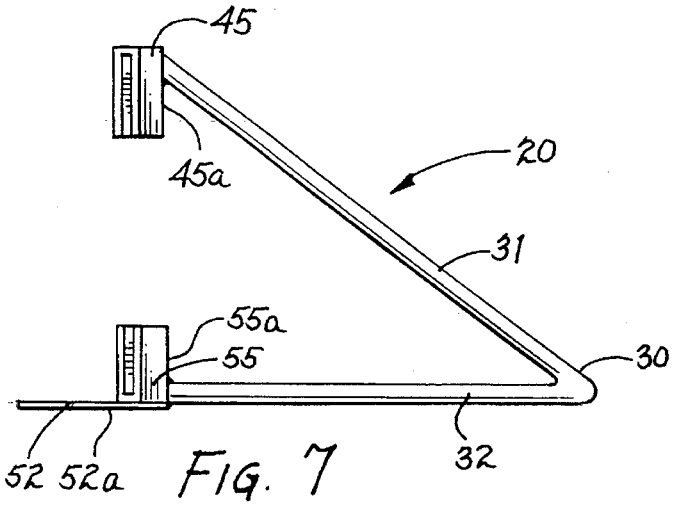
Figure 8:
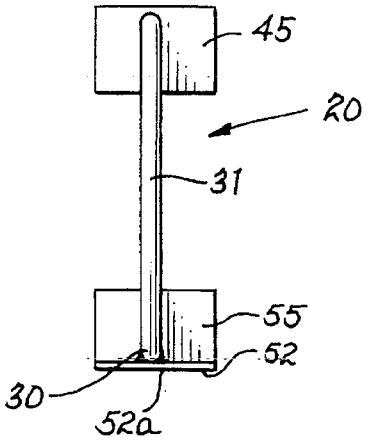
FIG. 8 Rear View of the Second Embodiment Wall Brace Invention of FIG. 7.

FIGS. 6–8 show different views of a second embodiment wall brace 20 for holding walls 60 together and supporting these walls in upright positions. Wall brace 20 is generally identical to wall brace 10. As shown in FIGS. 6–8, the main difference between wall braces 10 and 20 is that wall braces 20 hold a plurality of walls 60 at an angle to each other as opposed to adjacently to and in general alignment with each other, which is the manner in which wall braces 10 hold the walls 60.

Wall brace 20 has the same frame 30 and is generally constructed in the same manner as wall brace 10. As shown in FIGS. 6–8, wall brace 20, however, has a top bracing member 45 that is attached to the upper end of support member 31 of frame 30. The top bracing member 45 is generally an angled rectangular clamp that has an angled open side and two open ends, and the angled clamp is attached to the support member 31 at an outer edge 45*a* formed by the angle of the bracing member 45 (i.e. See FIGS. 6–7). A top side of one of the two walls 60 is received into one open end and a portion (i.e. one half) of the angled open side of the bracing member 45 while a top side of another wall 60 is received into the other end and the other portion (i.e. other half) of the angled side of the bracing member 45. The angled clamp covers, braces, and holds the top sides of the two walls 60 together at an angle respective to each other. The top bracing member 45 is also made of metal plate material (i.e. typically 12 gauge metal plates).

As shown in FIGS. 7 and 8, wall brace 20 also has a bottom bracing member 55 attached at an end of base 32 so that the bottom bracing member 55 is vertically and directly underneath top bracing member 45. Bottom bracing member 55 is also an angled rectangular clamp having an open side and two open ends, and the angled clamp is attached to the base 32 at an outer edge 55*a* formed by the angle of the bracing member 55. A bottom side of one of the two walls 60 is received into one open end and a portion (i.e. one half) of the angled open side of the bracing member 55 while a bottom side of another wall 60 is received into the other end and the other portion (i.e. other half) of the angled side of the bracing member 55. The angled clamp covers, braces, and holds the bottom sides of the two walls 60 together at an angle respective to each other. The bottom bracing member is also made of metal plate material (i.e. typically 12 gauge metal plates).

Furthermore, as shown in FIGS. 6–8, a flat plate 52 is attached to the bottom bracing member 55 (i.e. typically, to the bottom side of the bottom bracing member 55). In FIGS. 7 and 8, flat plate 52 has a horizontal surface 52*a* that extends outwardly from the bracing member 55. The horizontal surface 52*a* also rests on the ground, floor, or surface that supports the wall 60 (i.e. the ground, floor, or surface generally opposite to that on which the base 30 rests)to provide further support and stability to the walls 60 and to further ensure that these walls 60 are maintained in upright positions. Except for the differences discussed above, wall brace 20 encompasses all of the advantages and other features of wall brace 10.

Figure 12:
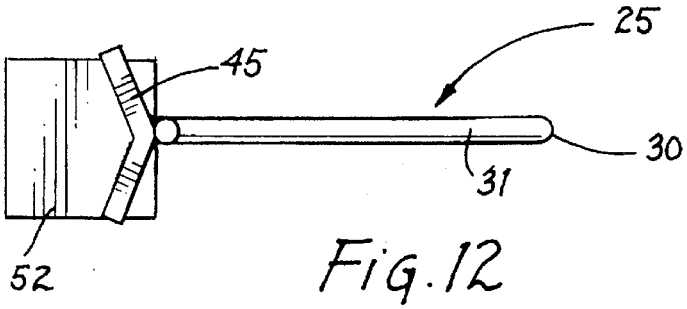
FIG. 12 Top Plan View of Another Version of the Second Embodiment Wall Brace Invention.
Figure 13:
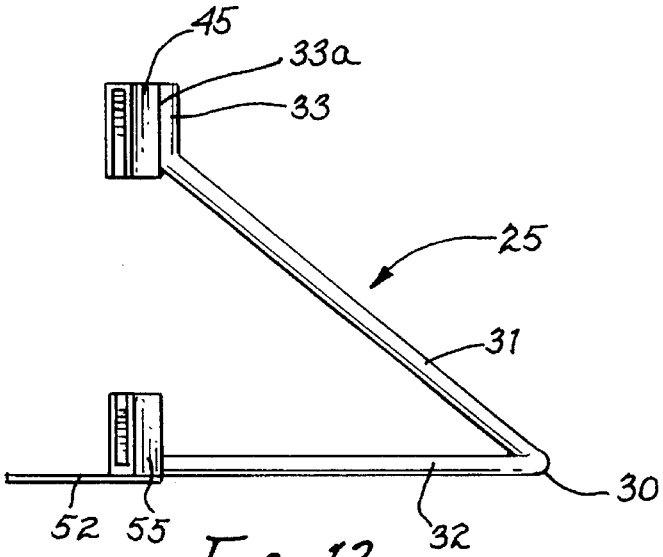
FIG. 13 Side View of the Second Embodiment Wall Brace Invention of FIG. 12.
Figure 14:
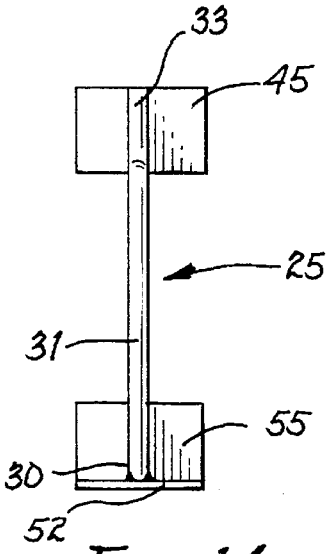
FIG. 14 Rear View of the Second Embodiment Wall Brace Invention of FIG. 13.

FIGS. 12–14 show a wall brace 25, which is another version of the second embodiment wall brace. Wall brace 25 is virtually identical to the above-described wall brace 20, and it also encompasses all of the advantages and features of wall brace 20. The main difference between wall braces 20 and 25, however, is that wall brace 25 has an additional vertical member 33 attached at the upper end of support member 31. As shown in FIG. 13, the vertical member 33 has a vertical surface 33*a* to which virtually an entire side of the top bracing member is attached.

The second embodiment wall braces generally function as corner wall braces to hold together and support corner walls of a structure (i.e. an arena or ring structure).

Figure 5:
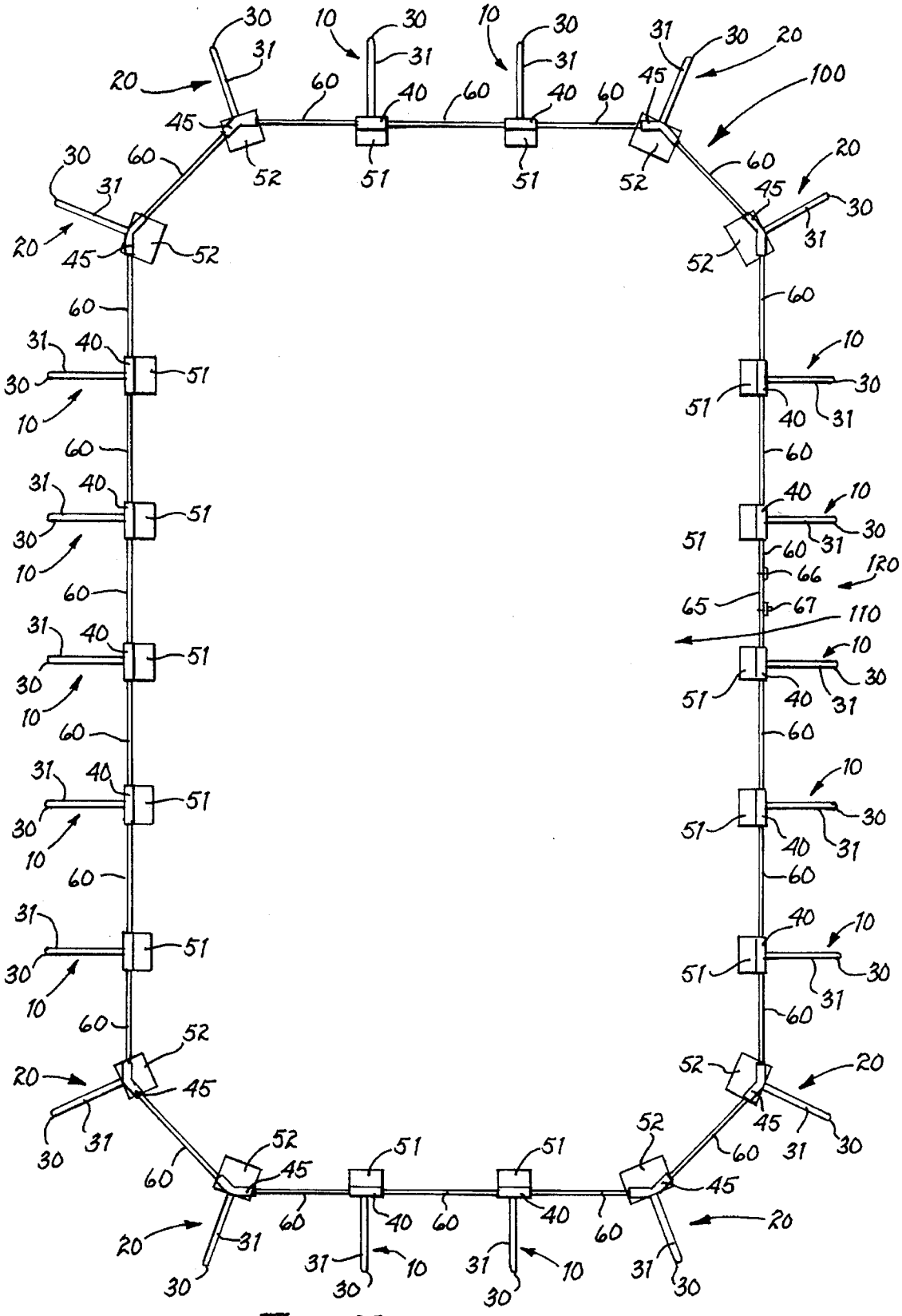
FIG. 5 Top Plan View of an Arena Formed by using the Present Invention Wall Braces.

Arena or Walled Enclosed Structure Formed by the Present Invention Wall Braces An arena or walled enclosed structure can be formed by a plurality of wall panels and a plurality of the present invention first and second embodiment wall braces. FIG. 5 shows an arena 100 that can be easily assembled or disassembled that is formed or constructed by providing a plurality of individual walls or panels 60, a plurality of first embodiment wall braces 10, and a plurality of second embodiment wall braces 20. (What is not shown in the figures is that a plurality of first embodiment wall braces 15 and a plurality of second embodiment wall braces 25 can alternatively be used to form the arena 100).

Arena 100 is formed by slidingly mounting the ends of two walls 60 into top and bottom bracing members 40 and 50 of each wall brace 10. The wall braces 10 hold a number of the walls 60 adjacent and in general alignment with each other at respective top sides and respective bottom sides of the walls 60. The wall braces 10 hold together and support a number of the walls 60 in upright positions to form the side walls of the arena.

Ends of two walls 60 are further slidingly mounted into top and bottom bracing members 45 and 55 of each wall brace 20. The wall braces 20 hold a number of the walls 60 at an angle to each other at respective top sides and respective bottom sides of the walls 60. The wall braces 20 hold together and support a number of the walls 60 in upright positions to form the corner walls of the arena.

Figure 15:
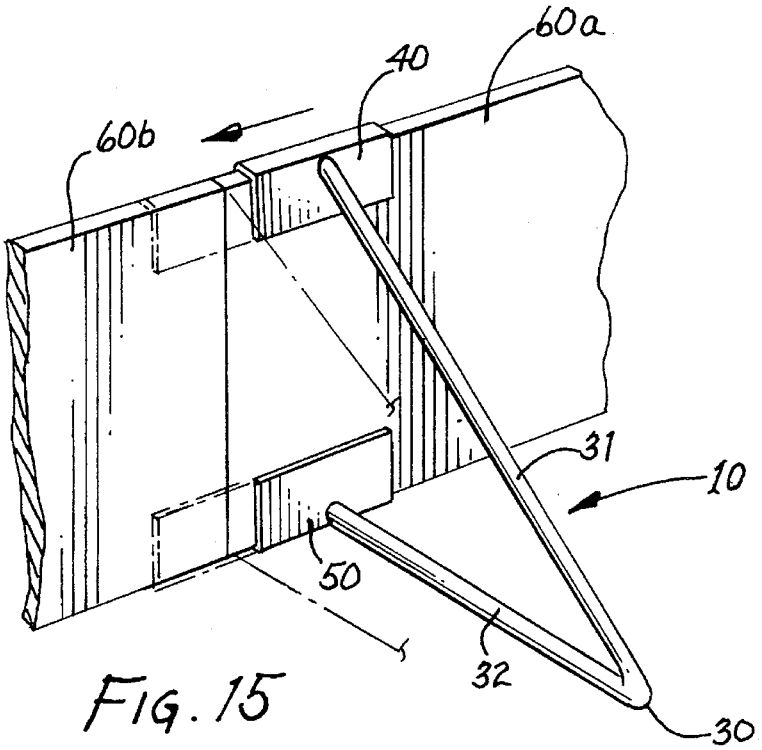
FIG. 15 Rear Perspective View of a Wall Brace that slidingly mounts and braces over two individual wall panels to enclose an arena.

Referring to FIGS. 1 and 15, arena 100 is completed and enclosed by slidingly mounting and bracing a last individual wall panel 60*b* between a first next-to-last wall panel 60*a* and a second next-to-last wall panel 60*c*. In FIG. 15, the last wall panel 60*b* is mounted and braced to next-to-last panels 60*a* and 60*c* by initially sliding a first wall brace 10, that is partially holding the panel 60*a*, entirely onto an edge of the panel 60*a*. One edge of the last panel 60*b* is slidingly mounted into a second wall brace 10, that is partially holding the panel 60*c*, so that the second wall brace 10 holds together the edges of both the panel 60*c* and the last panel 60*b*. The other edge of the last panel 60*b* is aligned with the edge of the panel 60*a*. As shown in FIG. 15, arena 100 is completed by sliding the first wall brace 10 partially back so that the first wall brace 10 holds together the edges of both the panel 60*a* and the last panel 60*b*.

The right side of FIG. 5 also shows arena 100 with a wall 60 that has a door 65. Door 65 has hinges 66 and latching or locking mechanism 67, and the hinged door 65 allows for convenient access into the interior 110 of arena 100 and out to the exterior 120 of arena 100. Arena 100 can be used for a number of purposes, such as for various sports activities, exhibitions, and other such events.

The foregoing description of a preferred embodiment and best mode of the invention known to applicant at the time of filing the application has been presented for the purposes of illustration and description. It is not intended to be exhaustive or to limit the invention to the precise form disclose, and obviously many modifications and variations are possible in the light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

Working Embodiment Example of the Present Invention Wall Brace

Angle between Support Member & Base of the Frame=45 Degrees

Height of Open Vertical Side of Wall Brace=48"

Length of Base=48"

Material of Top and Bottom Bracing Members=12 Gauge Plates

Outer Diameter of the Frame Tubing=1.25"

Width and Height of Top & Bottom Bracing Members=8"×8"

What is claimed is:

1. A wall brace for holding at least two walls together and supporting the at least two walls in upright positions comprising:

a frame having a support member and a base which provides support to the at least two walls to maintain the at least two walls in upright positions, a separate one piece top bracing member attached to the support member of the frame that covers a portion of the top edges of the at least two walls for holding together top sides of the at least two walls and for holding the at least two walls generally in contact with each other at side edges of the at least two walls, and a separate one piece bottom bracing member attached to the base of the frame that covers a portion of the bottom edges of the at least two walls for holding together bottom sides of the at least two walls and for holding the at least two walls generally in contact with each other at side edges of the at least two walls.

2. The wall brace according to claim 1 wherein the support member and the base of the frame generally define a triangular frame having a vertical open side wherein the at least two walls are received.

3. A wall brace for holding at least two walls together and supporting the at least two walls in upright positions comprising:

a frame having a support member and a base which provides support to the at least two walls to maintain the at least two walls in upright positions and wherein the support member and the base of the frame generally define a triangular frame having a vertical open side wherein the at least two walls are received, a separate one piece top bracing member attached to the support member of the frame for holding together top sides of the at least two walls, and a separate one piece bottom bracing member attached to the base of the frame for holding together bottom sides of the at least two walls.

4. The wall brace according to claim 3 wherein the base of the frame has a flat bottom.

5. The wall brace according to claim 3 wherein the top bracing member and the bottom bracing member further comprise:

serrated teeth attached to an inner portion of the top bracing member for gripping the top sides of the at least two walls, and serrated teeth attached to an inner portion of the bottom bracing member for gripping the bottom sides of the at least two walls.

6. The wall brace according to claim 3 wherein a side of the top bracing member is attached to an upper end of the support member.

7. The wall brace according to claim 6 wherein the upper end of the support member further comprises a vertical member having a vertical surface to which the side of the top bracing member is attached.

8. The wall brace according to claim 3 wherein a side of the bottom bracing member is attached to an end of the base.

9. The wall brace according to claim 3 wherein the at least two walls are braced adjacently to and in alignment with each other by the top bracing member and the bottom bracing member.

10. The wall brace according to claim 3 wherein the at least two walls are braced at an angle to each other by the top bracing member and the bottom bracing member.

11. The wall brace according to claim 3 wherein an inner top surface of the top bracing member and an inner bottom surface of the bottom bracing member are made to be a height apart from each other that is slightly smaller than the height of the at least two walls so that the at least two walls firmly fit between the top bracing member and the bottom bracing member.

12. The wall brace according to claim 3 wherein the top bracing member and the bottom bracing member are each a generally rectangular clamp wherein each clamp has an open side and two open ends and wherein sides of the at least two walls are received into the open side and the two open ends of each clamp to brace the at least two walls.

13. The wall brace according to claim 3 wherein the at least two walls are easily assembled to and disassembled from the top bracing member and the bottom bracing member.

14. The wall brace according to claim 3 wherein the bottom bracing member further comprises a flat plate attached to the bottom bracing member having a horizontal surface that provides further support to the at least two walls to maintain the at least two walls in upright positions.

15. The wall brace according to claim 3 wherein the length of the base is made approximately equal to the height of the at least two walls to ensure further support to the at least two walls.

16. The wall brace according to claim 3 wherein the frame is a moveable frame having a support member and a base placed on ground and moveable thereon which provides support to the at least two walls to maintain the at least two walls in upright positions.

17. The wall brace according to claim 3 wherein:

the top bracing member that is attached to the support member of the frame covers a portion of the top edges of the at least two walls for holding together top sides of the at least two walls, and the bottom bracing member that is attached to the base of the frame covers a portion of the bottom edges of the at least two walls for holding together bottom sides of the at least two walls.

18. An arena that can be easily assembled and disassembled comprising:

a plurality of individual wall panels, a plurality of side wall braces wherein each side wall brace has a top bracing member and a bottom bracing member that receives and holds at least two individual wall panels adjacently and in general alignment with each other at respective top sides and respective bottom sides of the at least two wall panels and wherein the plurality of side wall braces support a number of the at least two wall panels in upright positions to form side walls, and a plurality of corner wall braces wherein each corner wall brace has a top bracing member and a bottom bracing member that receives and holds at least two individual wall panels at an angle to each other at respective top sides and respective bottom sides of the at least two wall panels and wherein the plurality of corner wall braces support a number of the at least two wall panels in upright positions to form corner walls.

19. The arena according to claim 18 wherein at least one of the individual wall panels further comprises:

at least one hinged door for allowing convenient access into and out of the arena.

20. The arena according to claim 18 wherein the arena is an arena for roller hockey.

21. The arena according to claim 18 wherein:

the plurality of side wall braces further comprises a plurality of side wall braces that are placed on ground and moveable thereon wherein each side wall brace has a top bracing member and a bottom bracing member, and the plurality of corner wall braces further comprises a plurality of corner wall braces that are placed on ground and moveable thereon wherein each corner wall brace has a top bracing member and a bottom bracing member.

22. The arena according to claim 18 wherein:

the plurality of side wall braces further comprises a plurality of side wall braces wherein each side wall brace has a top bracing member that covers a portion of the top edges of the at least two individual wall members and a bottom bracing member that covers a portion of the bottom edges of the at least two individual wall panels, and the plurality of corner wall braces further comprises a plurality of corner wall braces wherein each corner wall brace has a top bracing member that covers a portion of the top edges of the at least two individual wall panels and a bottom bracing member that covers a portion of the bottom edges of the at least two individual wall panels.

23. A method of holding at least two walls together and supporting the at least two walls in upright positions and in general contact with each other at side edges of the at least two walls comprising the steps of:

bracing respective top sides of the at least two walls together with a top bracing member that covers a portion of the top edges of the at least two walls and further bracing respective bottom sides of the at least two walls with a bottom bracing member that covers a portion of the bottom edges of the at least two walls, and supporting the top bracing member and the bottom bracing member with a frame to maintain the at least two walls in upright positions and in general contact with each other at side edges of the at least two walls.

24. The method of holding at least two walls together according to claim 23 wherein the step of supporting further comprises the step of:

providing a frame having a support member and a base which provides the support to the top bracing member and the bottom bracing member to maintain the at least two walls in upright positions.

25. The method of holding at least two walls together according to claim 23 wherein the bracing step further comprises the step of:

gripping the respective top sides and the respective bottom sides of the at least two walls with serrated teeth that are attached to inner portions of the top bracing member and inner portions of the bottom bracing member.

26. The method of holding at least two walls together according to claim 23 wherein the bracing step further comprises the step of:

bracing the respective top sides and the respective bottom sides of the at least two walls adjacently to and in alignment with each other.

27. The method of holding at least two walls together according to claim 23 wherein the bracing step further comprises the step of:

bracing the respective top sides and the respective bottom sides of the at least two walls at an angle to each other.

28. The method of holding at least two walls together according to claim 23 wherein the bracing step further comprises the step of:

firmly fitting the at least two walls between the top bracing member and the bottom bracing member.

29. The method of holding at least two walls together according to claim 23 wherein the bracing step further comprises the step of:

allowing the at least two walls to be easily assembled to and disassembled from the top bracing member and the bottom bracing member.

30. The method of holding at least two walls together according to claim 23 further comprising the step of:

providing a flat plate attached at a bottom side of the bottom bracing member having a horizontal surface that provides further support to the at least two walls to maintain the at least two walls in upright positions.

31. The method of holding at least two walls together according to claim 23 wherein the supporting step further comprises the step of:

supporting the top bracing member and the bottom bracing member with a frame that is placed on ground and moveable thereon to maintain the at least two walls in upright positions.

32. A method of constructing an arena that can be easily assembled and disassembled comprising the steps of:

providing a plurality of individual wall panels, a plurality of side wall braces, and a plurality of corner wall braces, slidingly mounting and bracing ends of at least two individual wall panels into top and bottom bracing members of each side wall brace so that the at least two wall panels are adjacent and in general alignment with each other at respective top sides and respective bottom sides of the wall panels and so that a number of at least two wall panels are supported in upright positions to form side walls of the arena, slidingly mounting and bracing ends of at least two individual wall panels into top and bottom bracing members of each corner wall brace so that the at least two wall panels are at an angle to each other at respective top sides and respective bottom sides of the wall panels and so that a number of at least two wall panels are supported in upright positions to form corner walls of the arena, and slidingly mounting and bracing a last individual wall panel between a first next-to-last individual wall panel and a second next-to-last individual wall panel to enclose the arena.

33. The method of constructing an arena according to claim 32 wherein the step of slidingly mounting and bracing a last individual wall panel between a first next-to-last individual wall panel and a second next-to-last individual wall panel further comprises the steps of:

initially sliding a first side wall brace, that is partially holding the first next-to-last individual wall panel, entirely onto an edge of the first next-to-last individual wall panel, slidingly mounting one edge of the last individual wall panel into a second side wall brace, that is partially holding the second next-to-last individual wall panel, so that the second side wall brace holds the edges of both the second next-to-last individual wall panel and the last individual wall panel, aligning another edge of the last individual wall panel with the edge of the first next-to-last individual wall panel, and sliding the first side wall brace partially back so that the first side wall brace holds the edges of both the first next-to-last individual wall panel and the last individual wall panel.

* * * * *